US009556002B2

(12) United States Patent
Wilke et al.

(10) Patent No.: US 9,556,002 B2
(45) Date of Patent: Jan. 31, 2017

(54) ELEVATOR NOISE MONITORING

(71) Applicant: OTIS ELEVATOR COMPANY, Farmington, CT (US)

(72) Inventors: Michael Wilke, Berlin (DE); George Scott Copeland, Wethersfield, CT (US); Soumitra Borthakur, Rocky Hill, CT (US); Kelly Martin Dubois, Unionville, CT (US); Juan Jose Fernandez, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/895,955

(22) PCT Filed: Jun. 10, 2013

(86) PCT No.: PCT/US2013/044959

§ 371 (c)(1),
(2) Date: Dec. 4, 2015

(87) PCT Pub. No.: WO2014/200457

PCT Pub. Date: Dec. 18, 2014

(65) Prior Publication Data

US 2016/0130114 A1 May 12, 2016

(51) Int. Cl.
*B66B 5/00* (2006.01)

(52) U.S. Cl.
CPC ..... *B66B 5/0025* (2013.01)

(58) Field of Classification Search
CPC ..... B66B 5/0025
See application file for complete search history.

(56) References Cited

U.S. PATENT DOCUMENTS 5,042,621 A * 8/1991 Ovaska ..... B66B 1/34 187/277
5,135,079 A * 8/1992 Shimazaki ..... B66B 11/0015 181/206
5,254,813 A * 10/1993 Hirashiki ..... B66B 1/34 187/247

(Continued)

FOREIGN PATENT DOCUMENTS

JP 200824420 A 2/2008
WO 2005118450 A1 12/2005

(Continued)

OTHER PUBLICATIONS

International Search Report for PCT Application No. PCT/US2013/044959, dated Mar. 14, 2014, pp. 1-5.

(Continued)

*Primary Examiner* — Robert W Horn
(74) *Attorney, Agent, or Firm* — Cantor Colburn LLP

(57) ABSTRACT

A method includes receiving, from a portable recording device, multiple recordings of sounds made by an elevator during operation of the elevator, the multiple recordings generated at different times. The method includes analyzing, by a sound analysis circuit, the multiple recordings generated at the different times to detect changes in an elevator characteristic over time and generating, based on detecting the changes in the elevator characteristic over time, a notification to perform an action on the elevator.

13 Claims, 2 Drawing Sheets

(56) References Cited

U.S. PATENT DOCUMENTS

| | | | | |
|---|---|---|---|---|
| 5,522,480 | A * | 6/1996 | Hofmann | B66B 1/3492 187/288 |
| 5,616,895 | A * | 4/1997 | Spiess | B66B 13/22 187/280 |
| 6,604,611 | B2 | 8/2003 | Liu et al. | |
| 7,004,289 | B2 * | 2/2006 | Shrum, III | B66B 5/0087 187/393 |
| 7,298,256 | B2 * | 11/2007 | Sato | G08B 31/00 340/539.11 |
| 7,484,598 | B2 * | 2/2009 | Tyni | B66B 5/0025 187/291 |
| 8,028,807 | B2 * | 10/2011 | Deplazes | B66B 5/0025 187/247 |
| 8,418,815 | B2 * | 4/2013 | Encinas Carreno | B66B 5/0006 187/247 |
| 8,540,057 | B2 * | 9/2013 | Schuster | B66B 1/34 187/247 |
| 8,893,858 | B2 * | 11/2014 | Shi | B66B 5/0025 187/247 |
| 9,213,473 | B2 * | 12/2015 | Hovi | G06F 3/0484 |
| 9,309,089 | B2 * | 4/2016 | Annen | B66B 5/0037 |
| 9,394,138 | B2 * | 7/2016 | Blanc | B66B 7/00 |
| 2010/0094633 | A1 | 4/2010 | Kawamura et al. | |
| 2011/0240414 | A1 | 10/2011 | Carreno et al. | |
| 2013/0246928 | A1 * | 9/2013 | Hovi | G06F 3/0484 715/738 |
| 2014/0262629 | A1 * | 9/2014 | Toutaoui | B66B 1/3461 187/393 |
| 2015/0284214 | A1 * | 10/2015 | Park | B66B 5/0018 187/393 |
| 2016/0130114 | A1 * | 5/2016 | Wilke | B66B 5/0025 187/393 |

FOREIGN PATENT DOCUMENTS

| | | | |
|---|---|---|---|
| WO | 2007093665 | A1 | 8/2007 |
| WO | 2009126140 | A1 | 10/2009 |

OTHER PUBLICATIONS

Written Opinion for PCT Application No. PCT/US2013/044959, dated Mar. 14, 2014, pp. 1-5.

* cited by examiner

ELEVATOR NOISE MONITORING

BACKGROUND OF THE INVENTION

Embodiments of the invention relate to elevator system and in particular to maintenance of elevators by detecting changes in elevator noises over time.

Elevator service providers typically rely upon user complaints of an elevator malfunction or failure before elevator components are repaired or replaced. This requires the elevator to be taken off-line at unscheduled times, since it is not known when an elevator component or system will fail.

In addition, diagnosis and monitoring of elevator systems before and after component failures or malfunctions requires access to circuitry, control boxes, drive systems or other components that may be hidden behind elevator car panels or otherwise out of sight during normal operation. Accessing the circuitry, control boxes, drive systems or other components may also require that the elevator be taken out-of-service while a technician accesses the systems or components.

BRIEF DESCRIPTION OF THE INVENTION

Embodiments of the present invention include a method that includes receiving, from a portable recording device, multiple recordings of sounds made by an elevator during operation of the elevator, the multiple recordings generated at different times. The method includes analyzing, by a sound analysis circuit, the multiple recordings generated at the different times to detect changes in an elevator characteristic over time and generating, based on detecting the changes in the elevator characteristic over time, a notification to perform an action on the elevator.

Embodiments of the invention further include an elevator maintenance system including a data storage unit configured to store multiple recordings of elevator sounds, the multiple recordings generated at different times. The system includes a sound analysis circuit configured to analyze the multiple recordings to determine changes in the elevator sounds over time and a maintenance notification unit configured to generate an elevator maintenance notice based on the changes in the elevator sounds over time.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Servicing elevators to diagnose and repair component or system failures may result in the elevator being taken out-of-service, which may result in inconvenience to users. Embodiments of the invention relate to a system and method for monitoring elevator operation based on monitoring elevator sounds over time.

Figure 1:
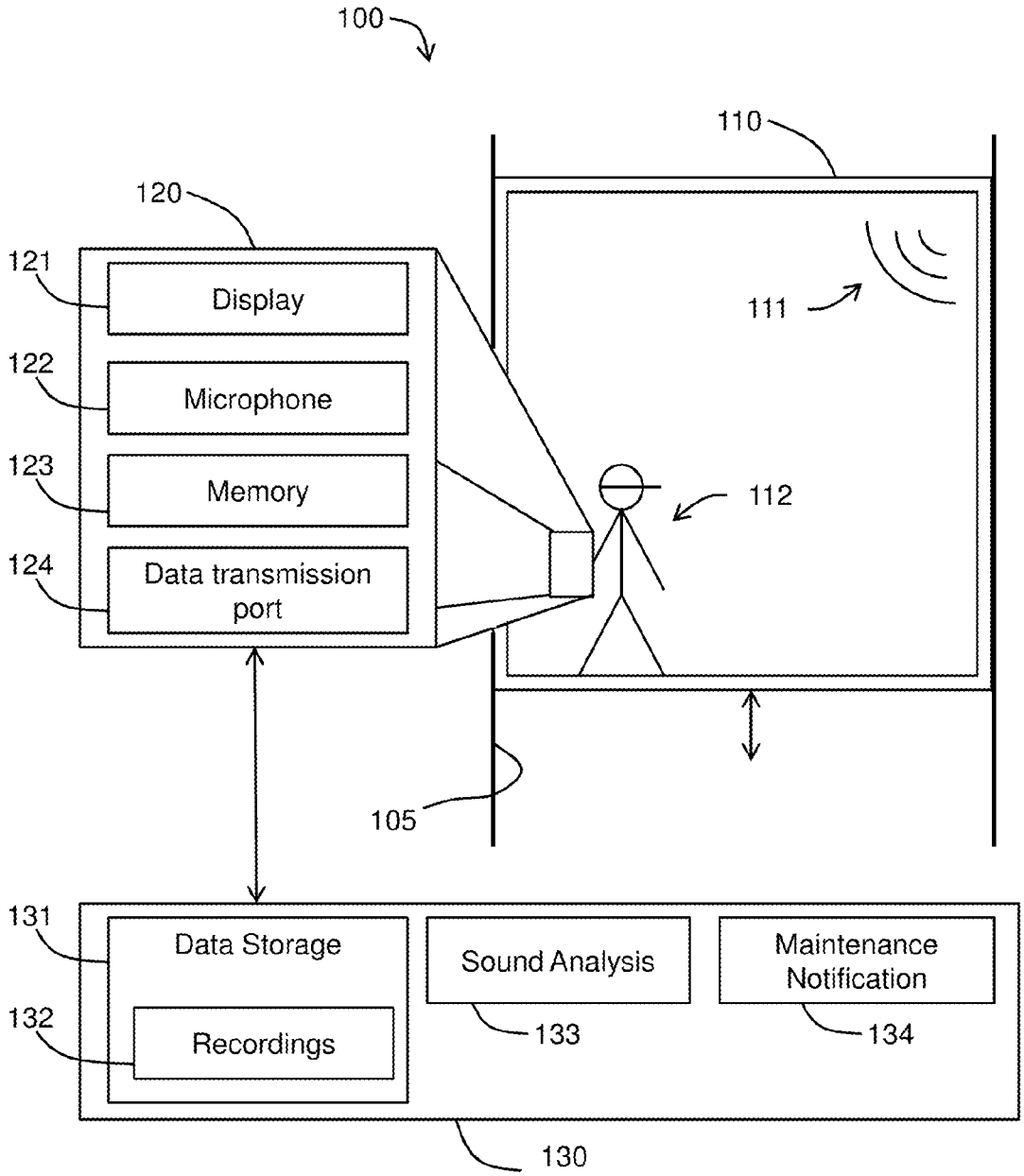
FIG. 1 illustrates an elevator system according to an embodiment of the invention.

FIG. 1 illustrates an elevator system 100 according to embodiments of the invention. The system 100 includes an elevator car 110 movable within a shaft 105, a portable monitoring unit or device 120, also referred to as a portable recording device 120, and a remote elevator maintenance system 130. In operation, a technician or other passenger 112 rides in the elevator car 110 during operation of the elevator car 110. The technician or passenger 112 carries or otherwise brings into the car 110 the portable monitoring unit 120. The portable monitoring unit 120 includes a display 121, microphone 122, memory 123 and data transmission port 124. The display 121 may be a visual display, such as a screen, or may include any manner of providing sensory input to the passenger 112. The microphone 122 detects sounds 111 of the elevator car 110 during operation of the elevator car 110 and generates recordings of the sounds 111 in memory 123.

In embodiments of the invention, the portable monitoring device 120 may be a dedicated monitoring tool for a technician, a handheld device including multiple different functions, such as a cell phone or smart phone including a microphone 122 and running a program to store the elevator sounds 111 or any other portable device capable of recording and storing the elevator sounds 111.

The data transmission port 124 communicates with the remote elevator maintenance system 130 to transmit the recordings 132 of the elevator sounds 111 to data storage 131 in the maintenance system 130. The data transmission port 124 may be a wireless port or a wired port. The remote elevator maintenance system 130 may process the recordings 132 of the elevator sounds 111, such as by compressing or filtering the recordings 132, or by performing any other processing of the recordings 132.

In one embodiment, the remote maintenance system 130 is a computer system including at least one sound analysis circuit or program 133 to analyze elevator sounds 111. The maintenance system 130 may include one or more databases of elevator sounds and corresponding corrective or preventive maintenance actions to be taken based on the recordings 132. The maintenance system 130 includes a maintenance notification unit 134 that identifies the corrective or preventative maintenance issues to be performed based on the analyzed recordings 132 and generates alerts, suggestions or notices to elevator technicians to perform corrective or preventive maintenance.

The remote elevator maintenance system 130 may include separate circuits to correspond to the data storage 131, the sound analysis circuit 133 and the maintenance notification circuit 134. Alternatively, the data storage 131, sound analysis circuit 133 and maintenance notification circuit 134 may each share the same memory and processors. In one embodiment, the sound analysis circuit 133 and maintenance notification circuit 134 include software executed by a processor to perform sound analysis and maintenance notification. In one embodiment, the data storage 131, sound analysis circuit 133 and maintenance notification 134 are all located within a same housing, such as a same server housing. In an alternative embodiment, the data storage 131, sound analysis 133 and maintenance notification circuit 134 may have a distributed architecture, and may be housed within different housings or computers connected via a network.

In embodiments of the invention, the data storage 131 of the maintenance system 130 is configured to store multiple different recordings 132 of elevator sounds 111 corresponding to a same elevator car 110. For example, each file including a recording 132 generated by the portable monitoring unit 120 may include identifying information regarding the elevator that the recording is associated with and a time that the recording was made. The identifying information may be input by the passenger 112, by location identification circuitry, such as global positioning system (GPS) hardware and software in the portable monitoring device 120, by an elevator identification signal generated by a control system of the elevator car 110 or by any other method.

In one embodiment, the passenger 112 is an elevator maintenance technician, and the recordings are generated during regularly-scheduled visits, such as visits scheduled at least one week apart or at least one month apart. In another embodiment, a passenger 112 may be a user of an elevator or staff of a building in which the elevator is operated. The user or staff may be provided with a program or application in a handheld communications device, such as a cell phone, that allows the user or staff to record elevator sounds 111 and transmit the recordings 132 to the remote system 130.

In one embodiment, the sound analysis circuit 133 is configured to analyze the multiple recordings 132 to detected changes in recorded sounds 111 over time (e.g., over a period of days, weeks, months, years). For example, in an embodiment in which a technician rides in an elevator car each month to record the elevator sounds 111, the sound analysis circuit 133 may analyze the progression of sounds 111 in the recordings 132 over time to identify existing problems in the elevator car 110 or systems supporting the elevator car 110, or to identify potential problems that may arise in the future. Accordingly, the maintenance notification circuit 134 may generate alerts of presently-detected problems or may generate alerts regarding potential or likely problems that may arise in the future. The maintenance notification circuit 134 may suggest preventative maintenance solutions to prevent the potential or likely future problems. Accordingly, a technician 112 may perform a scheduled maintenance of the elevator car 110, and ideally the technician 112 may schedule the maintenance for time at which the elevator car 110 is not likely to be in heavy demand.

In one embodiment, the sound analysis circuit 133 compares a later sound recording 132 to an earlier sound recording to monitor changes in volume of sounds relative to a known or reference volume, changes in frequency of recurring sounds, changes in tone or pitch of sounds, the presence or absence of sounds in the later recording compared to previous recordings, or any other difference that may provide information regarding elevator car 110 system, including electrical systems, drive systems, auxiliary systems such as door-control systems or any other system capable of being monitored based on sounds 111.

In one embodiment, the sound analysis circuit 133 analyzes the multiple recordings 132 taken at different times to determine a rate of change of sounds, and to predict times at which components or systems may fail or will require maintenance based on the rate of change of the sounds over time.

In embodiments of the invention, the time between separate recordings may be of a predetermined length sufficient to permit the sound analysis unit 133 to analyze the sound of the elevator car 110. For example, it may be determined, based on the systems in an elevator car 110, that at least one week or at least one month is required between recordings to detect any change in sounds 111 generated by the elevator car 110 based on wear of components or systems of the elevator car 110. In other words, as gears, belts, chains or bearings gradually wear over time, a change in sound of the gears, belts, chains or bearings may be detected over a period of multiple months or years, where a noticeable change would not be detected over a period of days or weeks. Similarly, as electrical systems gradually wear, such as when electrical connections or components gradually wear down, changes in electrically-generated noises may be detected over a period of weeks and months, where a noticeable change would not be detected over a period of hours or days. Accordingly, an interval between scheduled recordings of the elevator sounds 111 by a technician or passenger may be scheduled to correspond to the particular systems of the elevator car 110 that are desired to be monitored.

In one embodiment, the portable monitoring device 120 includes a program or circuitry to diagnose problems and provide information to the technician or passenger 112 immediately upon recording the elevator sounds 111 with the microphone 122. In another embodiment, the portable monitoring device 120 wirelessly transmits the recordings 132 of the elevator sounds 111 to the remote elevator maintenance system 130, which immediately diagnoses problems in the elevator and transmits suggested solutions to the technician or passenger 112.

In one embodiment, one or both of the portable monitoring unit 120 and the remote elevator maintenance system 130 performs an immediate diagnosis of recorded elevator sounds 111, and the elevator maintenance system 130 also performs an analysis of the recordings 132 of the elevator sounds 111 over time. In other words, some elevator sounds 111 may, by themselves, indicate problems or issues that a technician 112 may immediately address, while other problems or potential problems may be detected only by analyzing the change in elevator sounds 111 over time. Accordingly, the elevator system 100 may include both circuitry to provide immediate analysis and diagnosis of presently-recorded elevator sounds 111 and analysis of recordings 132 of elevator sounds 111 over time.

In one embodiment, the elevator car 110 is a monitor-free elevator car 110 having no sound recording system or system monitoring system connected to, or mounted to, the elevator car. Instead, the elevator car 110 performance is monitored based on the scheduled visits of the technician 112. The technician 112 brings the portable monitoring device 120 on the scheduled maintenance visits and records the elevator sounds 111 which are used to monitor and diagnose problems with the elevator car 110.

Figure 2:
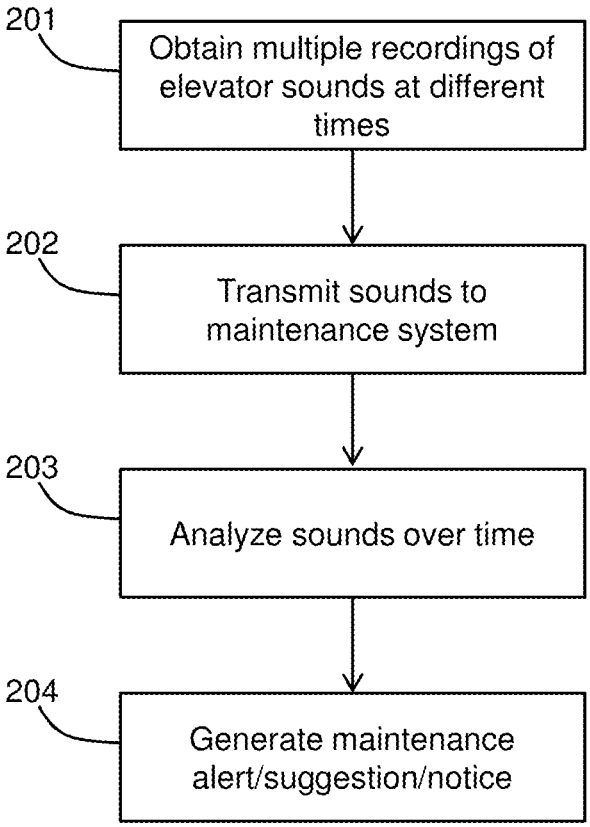
FIG. 2 illustrates a flow diagram of a method according to an embodiment of the invention.

FIG. 2 is a flowchart illustrating a method according to an embodiment of the invention. In block 201, multiple recordings of elevator sounds are obtained at different times. The elevator sounds may be generated by a user or technician standing inside an elevator car during operation of the elevator and recording the sounds with a portable recording device, for example. The recordings may be generated at times that are far enough apart to detect changes in the sounds over time. For example, the recordings may be generated at least a week apart or at least a month apart. In one embodiment, the recordings are obtained by a technician making regularly-scheduled visits to the elevator car to record the sounds made by the elevator during normal operation of the elevator. For example, the sounds may be recorded when the elevator is in normal operation available to normal users of the elevator.

In block 202, the multiple recordings of the elevator sounds are transmitted to a remote maintenance system. The transmission may be made via a wire or wirelessly. The remote maintenance system may store the multiple recordings in memory. In one embodiment, the remote maintenance system processes the recordings prior to storing the recordings, such as by compressing the recordings, filtering the recordings or performing any other processing. In block 203, the recordings of the elevator sounds are analyzed to detect changes in the elevator sounds over time. Changes in the elevator sounds may include changes in a volume of sounds over time, changes in a frequency, pitch or tone of a sound over time changes in the presence of sounds over time or any other changes that may be picked up by a microphone and analyzed by an analysis circuit.

In embodiments of the invention, the remote maintenance system may detect changes over time that may not be detectable in one recording, multiple recordings generated on a same day or in a time interval that is too small. For example, a change in a frequency generated by an electrical component or system may change only slightly or imperceptibly from one day to the next, but the change may be detected when recordings that are generated weeks apart are compared to each other. In embodiments of the invention, the remote maintenance system may determine a rate of change of sounds and may generate preventative maintenance notices by predicting when maintenance will be required based on a detected rate of change of the recorded elevator sounds over time.

In one embodiment, in addition to detecting changes in elevator sounds over time, the remote maintenance system may detect problems in the elevator based on the presence or absence of an elevator sound in a most-recently-generated recording. In other words, embodiments of the invention encompass detecting changes in elevator sounds over time as well as combining the detection of changes in sounds over time with the detection of the presence or absence of sounds in any one recording of the elevator sounds.

In block 204, the remote maintenance system generates a maintenance alert, suggestion or notice based on the analysis of the elevator sounds over time. For example, the remote maintenance system may transmit a notice to a technician to schedule preventative maintenance on a component of the elevator before a calculated date, based on analyzing the elevator sounds over time and predicting a likely failure of a component within some period of time after the calculated date.

According to embodiments of the invention, elevator components and systems are analyzed by recording elevator sounds at different times and analyzing the different recordings of the elevator sounds to determine changes in the elevator sounds over time. Accordingly, component or system failures may be reduced or eliminated in the elevator by performing preventative maintenance based on the calculated rate of change of elevator sounds, and calculated likely failure times of the components or systems. The ability to predict system failure allows for maintenance of the unit at a time when it is of least inconvenience to users. In addition, the total out-of-service time of the unit may be decreased over the lifetime of the unit, because unexpected system failures may be reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method, comprising:

receiving, from a portable recording device, multiple recordings of sounds made by an elevator during operation of the elevator, the multiple recordings generated at different times;

analyzing, by a sound analysis circuit, the multiple recordings generated at the different times to detect changes in an elevator characteristic over time; and generating, based on detecting the changes in the elevator characteristic over time, a notification to perform an action on the elevator.

2. The method of claim 1, wherein the portable recording device is a mobile telephone.

3. The method of claim 1, wherein the different times are spaced sufficiently apart to detect changes in the sounds made by the elevator that are detectable only over a predetermined time interval.

4. The method of claim 1, wherein the different times are spaced apart by at least one month.

5. The method of claim 1, wherein the multiple recordings are generated during normal operation of the elevator when the elevator is accessible by regular users of the elevator.

6. The method of claim 1, further comprising:

generating, with the portable recording device, the multiple recordings of the sounds made by the elevator during operation of the elevator at the different times.

7. The method of claim 6, further comprising:

analyzing, by the portable recording device, a most-recently-made recording of the sounds made by the elevator; and diagnosing, by the portable recording device, a problem of the elevator based on the most-recently-made recording of the sounds.

8. An elevator maintenance system, comprising:

a data storage unit configured to store multiple recordings of elevator sounds, the multiple recordings generated at different times;

a sound analysis circuit configured to analyze the multiple recordings to determine changes in the elevator sounds over time; and a maintenance notification unit configured to generate an elevator maintenance notice based on the changes in the elevator sounds over time.

9. The elevator maintenance system of claim 8, wherein each recording of the multiple recordings includes an identifier of an elevator corresponding to the recording and an identifier of a time that the recording was made.

10. The elevator maintenance system of claim 8, wherein the sound analysis circuit is configured to detect a rate of change of the elevator sounds over time and to predict a required maintenance time based on the detected rate of change of the elevator sounds.

11. The elevator maintenance system of claim 8, further comprising a portable recording device configured to be carried into the elevator to generate the multiple recordings of the elevator sounds during operation of the elevator.

12. The elevator maintenance system of claim 11, wherein the maintenance notification unit is configured to transmit the elevator maintenance notice to the portable recording device.

13. The elevator maintenance system of claim 11, wherein the portable recording device is configured to analyze a most-recently-generated recording of the elevator sounds and to diagnose a problem in the elevator based on the most-recently-generated recording of the elevator sounds.

* * * * *